US008707465B2

(12) United States Patent
Reynolds

(10) Patent No.: US 8,707,465 B2
(45) Date of Patent: Apr. 29, 2014

(54) YANK AND DRAW CONCEALED CARRY GARMENT

(76) Inventor: Andrew Reynolds, Grove City, OH (US)

( * ) Notice: Subject to any disclaimer, the term of this patent is extended or adjusted under 35 U.S.C. 154(b) by 367 days.

(21) Appl. No.: 13/046,128

(22) Filed: Mar. 11, 2011

(65) Prior Publication Data

US 2012/0227154 A1 Sep. 13, 2012

(51) Int. Cl.
*A41D 1/04* (2006.01)

(52) U.S. Cl.
USPC ..... 2/102; 2/217

(58) Field of Classification Search
USPC ..... 2/102, 217
See application file for complete search history.

(56) References Cited

U.S. PATENT DOCUMENTS

| | | | | |
|---|---|---|---|---|
| 3,812,539 | A * | 5/1974 | Muehlberg et al. | 2/69.5 |
| 5,101,514 | A * | 4/1992 | Eklund | 2/94 |
| 5,299,323 | A * | 4/1994 | Schaefer et al. | 2/93 |
| 6,317,894 | B1 * | 11/2001 | Blechman | 2/269 |
| 7,407,430 | B1 * | 8/2008 | Wanzenbock et al. | 450/63 |
| 2011/0277212 | A1 * | 11/2011 | Jones | 2/102 |
| 2012/0017348 | A1 * | 1/2012 | Ellsworth | 2/85 |

* cited by examiner

*Primary Examiner* — Katherine Moran
(74) *Attorney, Agent, or Firm* — Porter Wright Morris & Arthur, LLP

(57) ABSTRACT

A garment adapted for concealed carry weapons users wherein a pull grasp extends outside the garment from an opening in the garment front which leads to a passageway through the garment terminating at the forward collar of the garment and when the pull grasp is yanked downward, the lower section of the garment is raised and allows access to the weapon. The passageway comprises a tunnel adapted to receive the pull and is affixed to the lower seam of the garment.

15 Claims, 5 Drawing Sheets

YANK AND DRAW CONCEALED CARRY GARMENT

FIELD

The present invention relates to improvements in apparel worn by licensed concealed carry weapons users and allows a quick, easy and unobstructed weapons draw when a user is wearing the garment described herein.

BACKGROUND AND SUMMARY

In the prior art concealed carry handgun pistol holsters and carriers are known. However, when a weapon such as a handgun is covered or concealed by an outer garment, quick access to the concealed weapon may be hindered as an outer garment may obstruct removal of the handgun from its holster or carrier location when quick access to the weapon is necessary.

There are several ways of drawing a weapon from under a concealment garment. First, when wearing a pullover garment: You reach over with your support side hand, grab hold of the bottom edge of the garment under the weapon and pull the garment up and over the weapon. Because of a person's size, agility or lack of practice, this method can be impossible or too slow. Second, when an open or unsecured vest is worn, the draw involves using the hand that you are drawing the weapon with, cupping your fingers over the front opening of the garment and sweeping the side of the garment back far enough to get a good grip on the weapon. In this instance, the front of the garment must be open or able to be opened quickly. It also takes a lot of practice to become proficient.

In view of the deficiencies of the conventional practices described above, it is an object of the present invention to facilitate a quick draw when a holstered handgun is covered by an outer garment, namely, to unencumber access to the holstered weapon concealed by a garment.

The invention is described more fully in the following description of the preferred embodiment considered in view of the drawings in which:

DETAILED DESCRIPTION AND THE PREFERRED EMBODIMENT

In general, the invention is an upper torso garment that allows a user of a concealed carry weapon a quick, easy and unobstructed weapons draw. The garment includes a passageway within or upon the garment adapted to receive a longitudinally extending flexible pull. The passageway extends from a point near the forward collar of the garment to a lower section of the garment. The pull extends outside the garment from an opening in the passageway at the forward collar where it is reachable by the user. The lower end of the pull is secured to the garment at a location on the garment proximate a concealed weapon carried by the wearer beneath the garment. The terminal exterior section of the pull extends from the upper opening in the passageway at the forward collar of the garment, whereby when the extending section of the pull is yanked downward, the lower section of the garment is raised and allows access to the otherwise concealed weapon.

In variations, the garment can be made of multiple layers of material (e.g., a textile or vinyl or other garment material) forming the garment wherein a passageway is created between two of the layers. In another variation, the passageway may comprise a tunnel adapted to receive the pull wherein the tunnel is affixed to a layer of material forming the garment. Or the tunnel may be affixed to the exterior of the garment, or configured in the interior of the garment.

Figure 1:
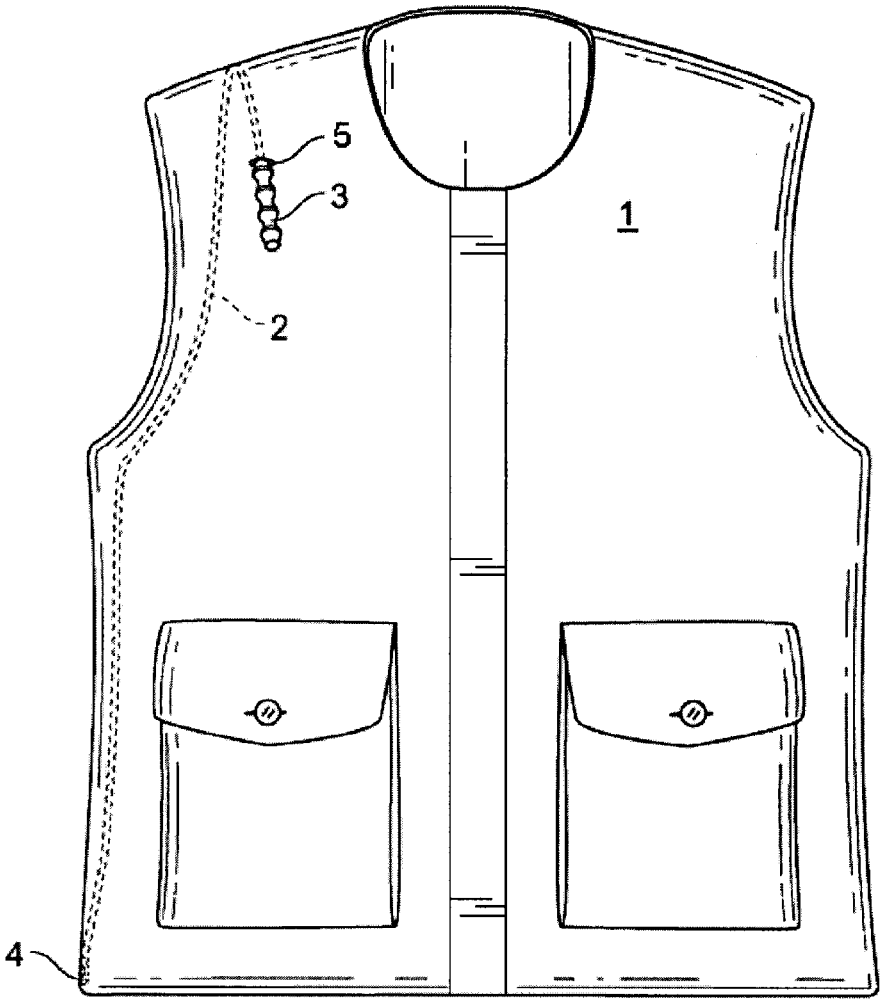
FIG. 1 is a front view of a vest showing the invention as used by a wearer having a right hand, strong side draw.

Referring to the device as Yank-N-Draw in the first example shown in FIG. 1, the garment is shown as vest 1. Lanyard 2 is a cord that is fixed by sewing to the inside bottom of the side seam of vest 1 as indicated at 4. The lanyard runs up between the inner layer and outer layer of the garment on the right side of garment. In an embodiment, the garment comprises a lanyard on each side. Depending on which side a person wears a weapon on their belt, the left side is a mirror image of the right. In an embodiment, the garment comprises a lanyard on each side of the garment. The lanyard passes over the collarbone, midway between the neck and shoulder and extends connected to a handle or grip 3, passing through eyelet 5. Defining the pathway of the lanyard, two layers of the vest material are sewn together on each side of the lanyard with enough space for lanyard to be able to move freely as if through a tunnel. This keeps the lanyard in proper placement so it will not slip down over the shoulder or be tangled in movement.

When a garment has only one layer of material, a one inch strip of like material is attached to run from the lower side seam up over the shoulder and to a point on the collar ending at an eyelet having a size, for example, of ¼ inch inside diameter. When each side of the length of the strip is sewn from the lower seam to the eyelet, a tunnel pathway for the lanyard to run through is formed.

Figure 2:
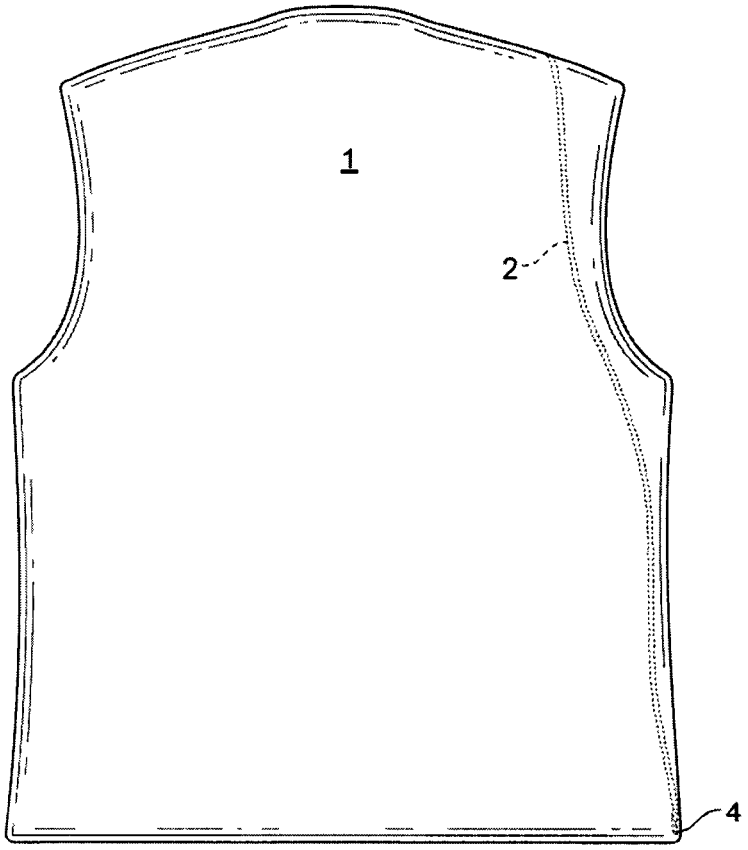
FIG. 2 is a back view of the vest of FIG. 1 showing the invention used in a right hand, strong side draw.

From the interior back view of the garment 1 shown in FIG. 2, the lanyard 2 goes over the shoulder and exits from the front at the ¼ inch eyelet which is placed about 4 inches down from the top center of the garment over the shoulder of the garment approximately midway between the neck and shoulder. The lanyard exits from the eyelet, where a handle 3, fixed to the lanyard end section, made of beads, a ball, a tube, other handle, or trinket of sufficient allows a firm hand hold is attached. Five beads of ⅝ inch diameter and ⅝ inch in length with a hole in the center for threading through the lanyard will work; likewise a graspable tube about ⅝ inch in diameter and about three inches long will work. When the garment is in a relaxed position, the beads can be placed on the upper lanyard pull section up to the eyelet. A permanent knot is tied beneath the beads to prevent the beads from pulling free from the lanyard.

Figure 3:
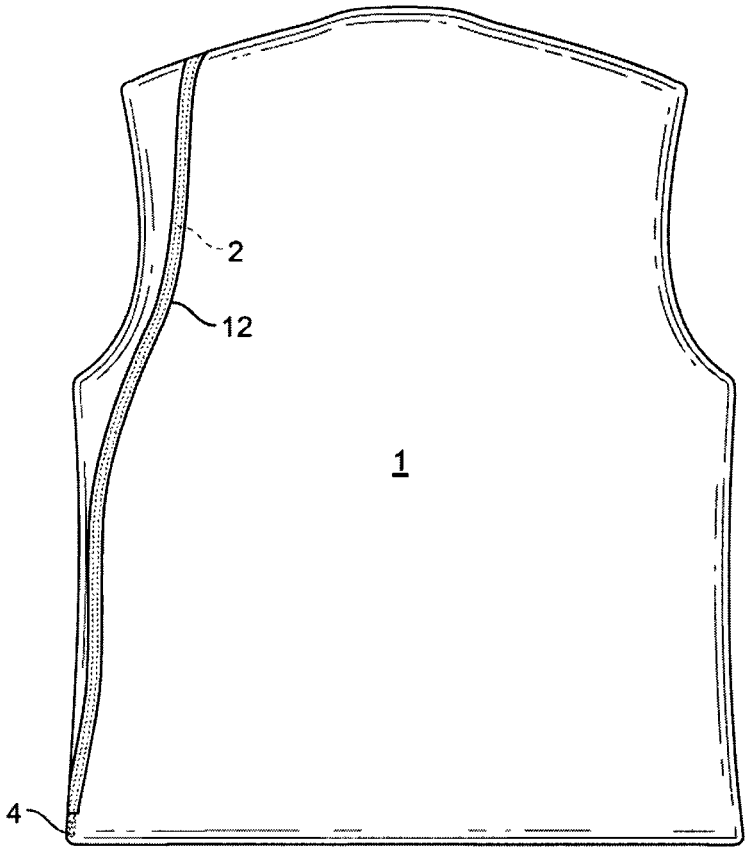
FIG. 3 is an inside view of a vest with a single layer of material as would be used by a wearer having a right hand draw.

FIG. 3 shows the invention in a garment having a single layer of material. In this example, garment 1 is a vest having a bottom seam to which the lanyard 2 and tunnel forming strip material 12 are secured. The strip is sewn or attached to the single layer of material on both side edges to form the tunnel. The tunnel 12 within which the lanyard is located extends over the shoulder, midway between the neck and shoulder to the front of the garment where the tunnel ends at an eyelet and the lanyard extends and ends with a reachable grip.

Figure 4:
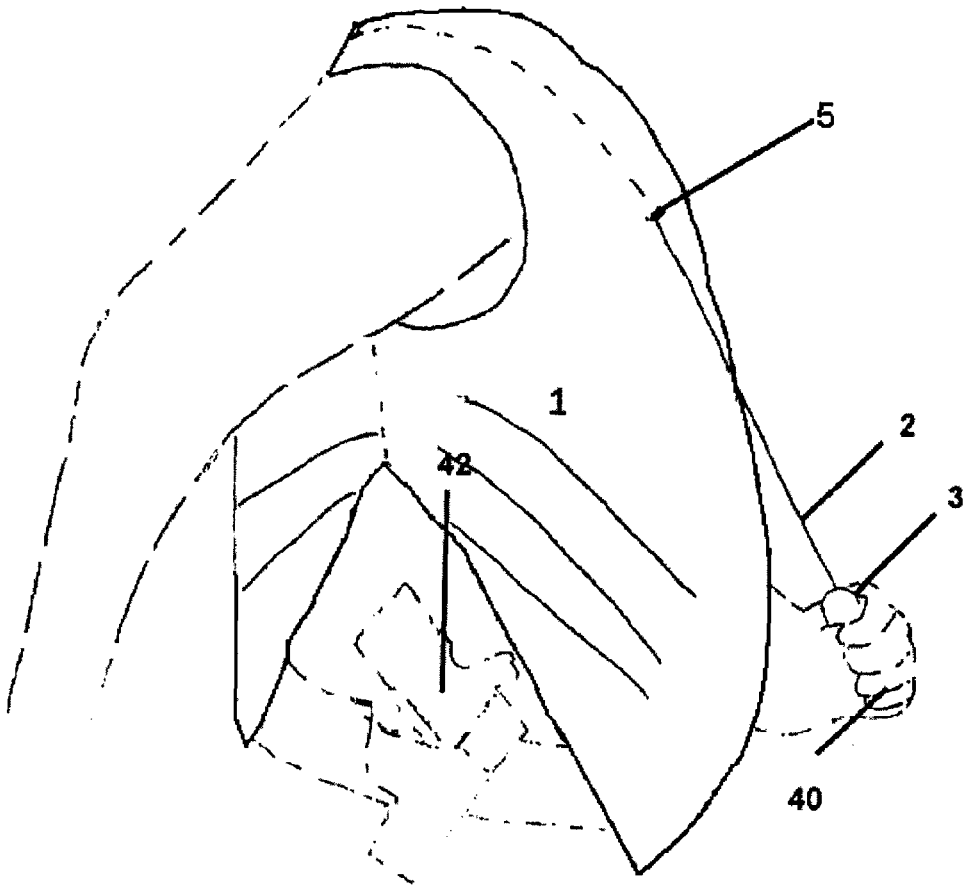
FIG. 4 is a right side view of a vest with the pull cord being drawn by the left hand to allow a right hand draw from a concealed holster.
Figure 5:
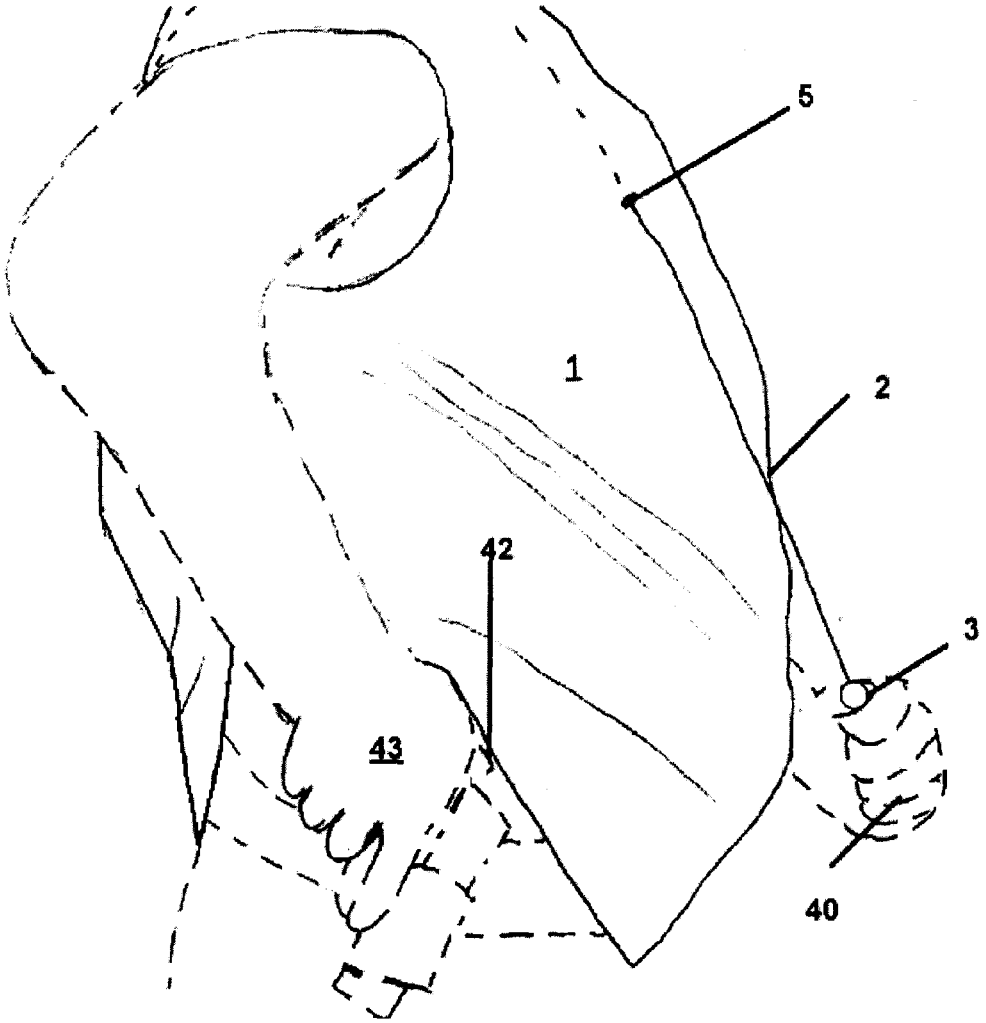
FIG. 5 is a right side view of a vest showing the pull cord fully extended, and the garment raised, exposing the weapon and holster.

As shown in FIG. 4, to use the Yank-N-Draw (right hand version), you reach over and get a firm hand hold on the lanyard. If you are right handed, use your left hand 40 to grab the pull beads (not shown) and yank down on the cord 2 which will be on the right side extending from eyelet 5. This pulls the lanyard, which pulls the right side of the garment up and over the weapon 42 carried on your belt. This gives you an unobstructed access to the weapon as depicted in FIG. 5. With your firing side (right) hand 43, obtain a full firing grip on the weapon. Let go of the lanyard with your support side hand 40, and then continue to perform the action of drawing the weapon. The invention includes accommodations for left-handed or persons that can use either hand as well. In an embodiment, the garment comprises pulls on both sides of the garment.

The invention can be adapted to many types of tactical garments already being made such as a garment vest, shirt or coat. The lanyard can be 550 cord, also known as parachute cord, however, any cord or string of equivalent and/or suitable strength can be used as the lanyard. The end pull can be a handle, beads, a ball, or a tube, of sufficient diameter to obtain a firm hand hold. As noted above, five beads of ⅝ inch diameter and ⅝ inch in length are appropriate. The bottom of side seam where the end of the lanyard is secured is securely sewn to garment. A ¼ inch inside diameter eyelet is fastened to the outer shell of the garment. The lanyard is run through this eyelet to keep material from ripping and otherwise maintain the pull in place.

With reference to FIG. 2 showing a back view, right hand, strong side draw, the garment is a matter of choice from many types of clothing and tactical garments being made to which the invention can be adapted. 550 cord or any cord of suitable strength can be used as a lanyard pull. The lanyard needs to be sewn in at the low point of the side seam with enough strength to withstand being yanked up, pulling the garment up over a weapon being carried on the hip. The lanyard is preferably placed at the mid-point of the collarbone, between neck and shoulder and preferably extends through an eyelet. If the garment has both an inner and outer layer of material the lanyard pull can be run between the layers and the layers sewn together on each side of the pull cord. This makes a tunnel for the lanyard to slide through. It will also keep the lanyard from slipping off the shoulder, which would affect the ability of the lanyard to pull the side of the garment up and over the weapon.

The foregoing disclosure and description of the invention is illustrative and explanatory thereof. Various changes in the details of the illustrated device can be made within the scope of the appended claims without departing from the spirit of the invention and its equivalents.

What is claimed is:

1. A garment comprising:

at least one layer of material forming the garment, the garment having right and left armholes for receiving a wearer's arms therethrough, right and left sides located beneath said armholes, an interior and an exterior, a forward collar portion, an opening located adjacent the forward collar of the garment, and a lower section, the garment configured to be worn about a wearer's upper torso such that the lower section of the garment will conceal a weapon carried on a wearer's hip;

a passageway within or upon the garment adapted to receive a longitudinally extending flexible pull, the passageway extending between said opening and the lower section of the garment; and a pull extending through the length of said passageway, said pull having an end which extends outside the passageway through said opening located adjacent the forward collar of the garment, and said pull secured to said lower section at the right or left side of the garment beneath the right or left armhole, the pull being operative to move the lower section of the garment, at the side of the garment to which the pull is secured, upwardly away from the wearer's hip so as to facilitate access to a weapon carried on the wearer's hip in response to a pulling movement of the end of the pull extending outside the passageway away from said opening.

2. The garment of claim 1 including multiple layers of material forming the garment and the passageway is between two of the layers.

3. The garment of claim 1 wherein the passageway comprises a tunnel formed between a layer of material forming the garment and a strip of material affixed thereto.

4. The garment of claim 3 wherein the tunnel is located on the exterior of the garment.

5. The garment of claim 3 wherein the tunnel is located in the interior of the garment.

6. The garment of claim 1 including an eyelet adjacent the forward collar portion of the garment through which the pull extends.

7. The garment of claim 6 wherein the end of the pull extending outside the passageway terminates in a handle configured to facilitate downward yanking of the pull by a wearer.

8. The garment of claim 7, wherein said handle comprises a plurality of beads, a ball or a tube.

9. The garment of claim 1, further comprising a second pull, wherein one of said pulls is secured to the lower section of the garment at the right side of the garment and the other pull is secured to the lower section of the garment at the left side of the garment.

10. The garment of claim 1, wherein said pull is secured to said lower section in the interior of the garment.

11. The garment of claim 10, wherein the garment includes a side seam extending along the right or left side of the garment beneath the right or left armhole, and said pull is secured to the side seam.

12. The garment of claim 10, wherein said pull comprises a cord.

13. A fabric garment configured to be worn about a wearer's upper torso, comprising:

at least one layer of material forming the garment, the garment having right and left armholes for receiving a wearer's arms therethrough, right and left sides located beneath said armholes, a side seam extending along the right or left side of the garment beneath the right or left armhole, a forward collar portion, an interior and an exterior, and a lower section, the garment configured to be worn about a user's upper torso such that the lower section of the garment will conceal a weapon carried on a wearer's hip;

a passageway within or upon the garment adapted to receive a longitudinally extending flexible cord, the passageway extending from an eyelet at the forward collar of the garment to a lower section of the garment;

a pull comprising a longitudinally extending flexible cord having an upper end which extends outside the garment from the eyelet at the forward collar and secured at its lower terminus to the lower section of the garment at the side seam of the right or left side of the garment beneath the right or left armhole, the upper end of said cord configured to facilitate grabbing of said upper end by a wearer, the pull being operative to move the lower section of the garment upwardly away from a wearer's hip in response to a downward pulling movement of the upper end of said cord so as to facilitate access to a weapon carried on the wearer's hip.

14. A method for accessing a user-carried weapon concealed by a lower section of a garment worn by the user about the user's upper torso, the garment having right and left sides located beneath the user's arms, a forward collar portion, an opening located adjacent the forward collar portion of the garment, a lower section which conceals the weapon carried on the user's right or left hip, and a flexible pull which extends outside the garment through said opening and is secured to the lower section of the garment at the side of the garment which conceals the weapon, wherein the pull extends over the user's shoulder, comprising the steps of:

(a) with one hand, yanking the portion of the pull extending from outside the garment away from the garment, thereby raising the lower section of the garment at the side to which the pull is secured to allow access, by the other hand, to the weapon; and (b) grasping the weapon with the other hand.

15. The method of claim 14, wherein yanking said pull causes the side of the garment to which the pull is secured to be pulled up and over the weapon.

* * * * *